US008696428B1

(12) United States Patent
Post

(10) Patent No.: US 8,696,428 B1
(45) Date of Patent: Apr. 15, 2014

(54) MULTI-PLAYER ELECTRONIC GAMING SYSTEM AND PROJECTILE SHOOTING COMMUNITY GAME PLAYED THEREON

(71) Applicant: Spielo International Canada ULC, Moncton (CA)

(72) Inventor: Peter Post, Moncton (CA)

(73) Assignee: Spielo International Canada ULC, Moncton, New Brunswick (CA)

( * ) Notice: Subject to any disclaimer, the term of this patent is extended or adjusted under 35 U.S.C. 154(b) by 0 days.

(21) Appl. No.: 13/722,518

(22) Filed: Dec. 20, 2012

(51) Int. Cl.
*A63F 9/24* (2006.01)

(52) U.S. Cl.
USPC ..... 463/16; 463/25; 463/30; 463/50; 273/138.1

(58) Field of Classification Search
USPC ..... 463/6–7, 16, 50, 46, 25
See application file for complete search history.

(56) References Cited

U.S. PATENT DOCUMENTS

| | | | | |
|---|---|---|---|---|
| 3,940,136 | A * | 2/1976 | Runte | 463/3 |
| 4,976,438 | A * | 12/1990 | Tashiro et al. | 463/34 |
| 5,114,157 | A * | 5/1992 | Kita | 463/29 |
| 7,140,962 | B2 * | 11/2006 | Okuda et al. | 463/2 |
| 7,682,239 | B2 * | 3/2010 | Friedman et al. | 463/16 |
| 7,976,372 | B2 * | 7/2011 | Baerlocher et al. | 463/12 |
| 8,430,408 | B2 * | 4/2013 | Baerlocher et al. | 273/309 |
| 2002/0185981 | A1 * | 12/2002 | Dietz et al. | 315/169.3 |
| 2004/0029636 | A1 | 2/2004 | Wells | |
| 2008/0234040 | A1 * | 9/2008 | Davies | 463/26 |
| 2009/0143141 | A1 * | 6/2009 | Wells et al. | 463/37 |
| 2009/0197676 | A1 | 8/2009 | Baerlocher et al. | |
| 2009/0325686 | A1 * | 12/2009 | Davis et al. | 463/25 |
| 2010/0240445 | A1 * | 9/2010 | Friedman et al. | 463/25 |
| 2012/0208623 | A1 * | 8/2012 | Friedman et al. | 463/25 |
| 2012/0270653 | A1 | 10/2012 | Kareemi et al. | |

FOREIGN PATENT DOCUMENTS

| | | | |
|---|---|---|---|
| AU | 2012202208 | A1 | 5/2012 |
| AU | 2013200781 | A1 | 2/2013 |
| CA | 2660176 | A1 | 3/2008 |

OTHER PUBLICATIONS

PCT/CA2013/050053 International Search Report and Written Opinion, 17 pages.

* cited by examiner

*Primary Examiner* — William Brewster
*Assistant Examiner* — Alex F. R. P. Rada, II
(74) *Attorney, Agent, or Firm* — Patent Law Group LLP; Brian D. Ogonowsky

(57) ABSTRACT

A large touch screen gaming table is disclosed that may accommodate, for example, four players. Each player creates a bank of credits at the table and plays a community game independently of other players. In one game, various icons are continuously displayed, and the icons display various wager amounts. Any player may simultaneous touch an icon of any wager and touch a player-active button, and the selected icon reveals a hidden prize credited to that player. In one embodiment, the game is continuous in that the icons are replenished after being selected. The players may play at any speed and in any order. The wagers may be very small and the prizes are generally also small to encourage rapid play. Any player(s) that does not wish to participate in the community game may control the screen to display a variety of individual games on a screen segment.

18 Claims, 8 Drawing Sheets

MULTI-PLAYER ELECTRONIC GAMING SYSTEM AND PROJECTILE SHOOTING COMMUNITY GAME PLAYED THEREON

FIELD OF THE INVENTION

This invention relates to electronic gaming systems and, in particular, to a gaming system where multiple players simultaneously play a game.

BACKGROUND

A typical gaming machine is intended for being played by a single player. However, players, such as in a casino, may want a more social experience yet not compete with other players or be otherwise adversely affected by the actions of other players.

What is needed is a gaming system and gaming methods wherein players may interact while playing a common game, wherein the players do not compete against each other, wherein the players' actions cannot substantially adversely impact the other players' gaming results, wherein the players may come and go without penalty, wherein the players may play independently, and wherein the players may bet a variety of different wagers.

SUMMARY

A large gaming table is disclosed that may accommodate, for example, four players. The gaming table comprises a large horizontal touch screen. Each player creates a bank of credits at the table and plays independently of other players.

Various types of games are described herein. In one game, various icons are continuously displayed. The icons display various wager amounts. Any player touches an icon of any wager, and the icon reveals a hidden prize for that player. The game is then over for that player's turn. The players may play independently. In order for the gaming system to identify the player that touched the icon, the active player touches a "player active" button while the player touches the icon. This effectively locks out other players when the "player active" button is pressed. The game may be infinite in that new hidden prizes are randomly assigned after an icon is selected or the icons are replenished after being extinguished by a selection. The players may play at any speed and in any order. The wagers may be relatively small, including a partial credit, and the prizes are generally also small to encourage rapid play.

In another embodiment, the game is a shooting game where all players may shoot, even simultaneously, at objects displayed on the screen. Awards are granted based on the players' hits or accumulated hits. Each shot is a wager.

Various embodiments of the games are described that create a very social atmosphere with no competition among players and where players play independently.

A player that does not wish to participate in the community game may control the screen to display a variety of individual games on a screen segment in front of the player, such as video poker, video reels, etc. This does not affect the other players. Thus, there is synergy in providing a large gaming table in that the players may play conventional games as well as the novel community games with the same hardware. The players are more apt to play longer at the gaming table than with conventional slot machines due to the social aspects of the gaming system. All four players may play four different individual games or any number of players may play the community game.

The community game may change automatically under control of the gaming system to add variety, such as change from an icon selection game to a shooting game or other game.

BRIEF DESCRIPTION OF THE DRAWINGS

Elements that are the same or equivalent are labeled with the same numeral.

DETAILED DESCRIPTION

Figure 1:
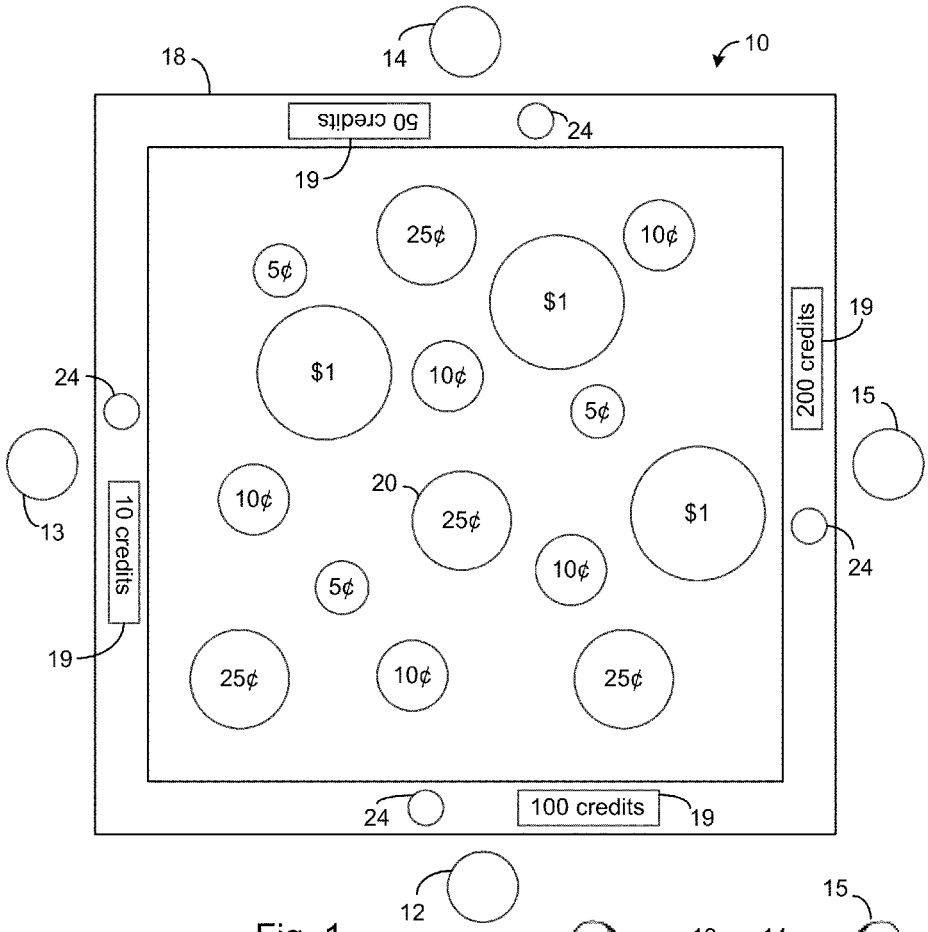
FIG. 1 is a top down view of the gaming table showing a particular icon-selection game in progress.
Figure 2:
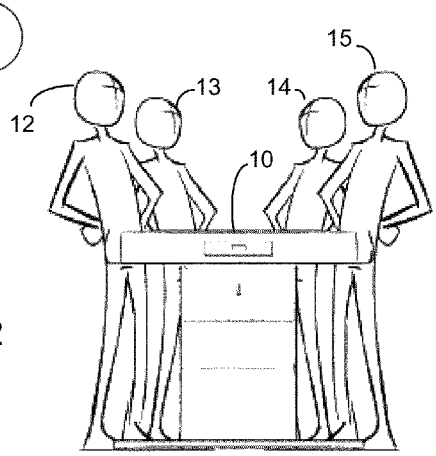
FIG. 2 is a side view of the gaming table and its players.

FIG. 1 is a top down view of a substantially horizontal gaming table 10 showing a particular icon-selection game in progress. A side view of the gaming table 10 is shown in FIG. 2 along with four players 12-15. FIG. 1 shows the entire top surface of the gaming table 10 as a touch screen 18 but, in an actual embodiment, there may be space for the players' drinks or an arm support.

The touch screen 18 technology may be conventional, such as a flat screen monitor with a capacitive-type touch screen overlay. The touch screen 18 is preferably square to make all the players' positions equivalent; however, rectangular touch screens are more commercially available. All player controls may be via the touch screen 18.

When a player arrives at the gaming table 10, the player creates a bank of credits, which are displayed at screen areas 19. The player may use a player tracking card, cash, a paper ticket, or other means to create the bank of credits. A conventional card reader or cash/ticket receiver may be located in the table 10 support structure.

In the game illustrated in FIG. 1, a variety of icons 20 are displayed having different wager amounts (or denominations). At least some of the icons 20 are associated with a randomly selected hidden prize. Other ones of the icons 20 may be losing icons awarding no prize. Generally, the awards for the higher wager icons 20 are higher than the lower wager icons 20. Examples of the wagers are 5 cents, 10 cents, 25 cents, and one dollar. When an icon 20 is touched, the advertised wager is deducted from the player's bank and the hidden prize is revealed and credited to the player's bank. The wager may even be a fraction of a single credit, and the fractions are added by the processor in the gaming system when deducting from or adding credits to the player's bank. The fractions may displayed in an area of the screen 18.

So that the gaming system knows which player made the icon selection, the selecting player touches a "player active" button 24 on the screen to briefly lock out other player until the selection is made. The button 24 may need to be touched while the player touches the icon 20, or the button 24 remains activated once touched until the player makes the selection. In one example, each player is associated with a different color and, when a player touches the button 24, all icons 20 turn that color to indicate to the other players who is the active player.

In one embodiment, players that concurrently touch their buttons 24 effectively select the same icon 20 that is touched by any one of the active players. This allows the players to truly share in the same gaming experience. Each player then wins a prize as if the players separately touched the icon 20.

Figure 3:
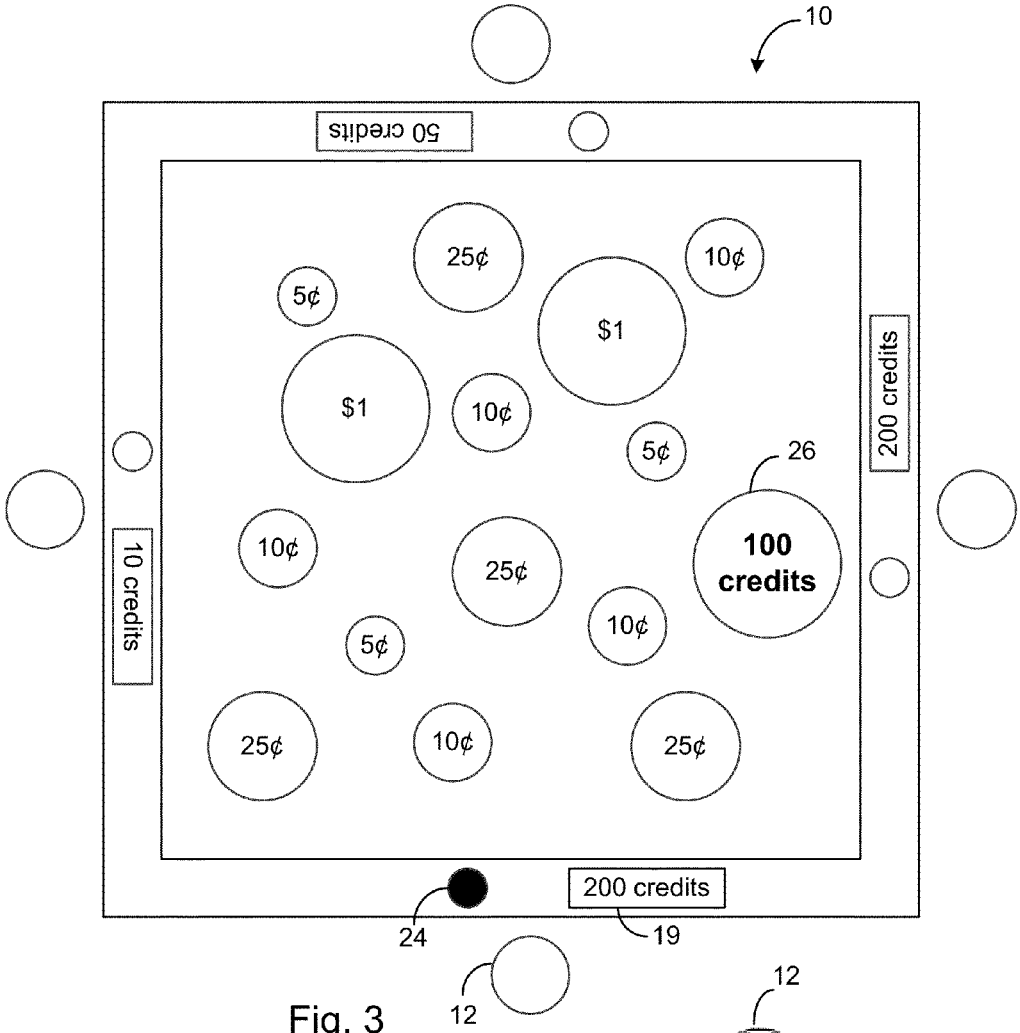
FIG. 3 illustrates the selection of an icon by one of the player and the hidden prize revealed.
Figure 4:
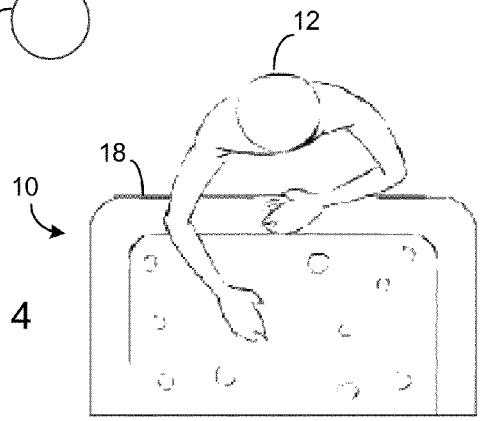
FIG. 4 is a top down view of the player touching a "player active" button while selecting an icon.

FIGS. 3 and 4 illustrate the player 12 touching the button 24 while touching the icon 26 to deduct the associated wager from the player's bank of credits and reveal a prize of 100 credits. The credits are then added to the player's bank of credits and displayed.

The players may play independently in a random order so as to play at their own comfortable rate. Any player may join the game or cash out without affecting the other players. Cash-out may be by printed ticket, chips, crediting the player's central account (if the player uses a player tracking card), an NFC based credit transfer on a smart phone, or other suitable means.

Accordingly, the game of FIGS. 1-4 is non-competitive, the players are not able to adversely impact the other players' gaming results, the players may come and go without penalty, the players may play independently, and the players may bet a variety of different wagers.

If the gaming system senses that the players are frequently selecting low-wager icons 20, the gaming system may control the screen 18 to display more of the low-wager icons 20 to give the players the illusion of having a greater selection. In actuality, the gaming system may assign the same randomly selected prize to all icons 20 of the same wager amount, or the system may assign a different randomly selected prize for each icon 20 of the same wager amount. The prize would change after each selection. In either case, the prize is still random.

After an icon 20 is selected, it may be extinguished and a new icon 20 appears elsewhere, or the icon 20 may remain after selection but with a new hidden prize. This creates an infinite game since the icons 20 are not depleted.

In another embodiment, the icons 20 are extinguished after being selected and not replenished until some number (including zero) of the icons 20 remain. In other embodiments, for a non-infinite game, the game may have a predetermined or selected time limit (e.g., 2-5 minutes), or the game ends when one player wins a certain end-game prize or wins a certain amount, or one or more of the players have a zero credit balance, or other threshold. A new game with a new set of icons 20 may then be initiated.

In another embodiment, a listing of some or all of the available hidden prizes represented by the displayed icons 20 is displayed to the players in a separate area of the screen 18 to add excitement. When a hidden prize is awarded, that prize is removed from the list. The game may end when, for example, the highest prize is won or upon another threshold being reached. In this way, the players are motivated to at least play the game until the highest prize is won.

Many other variations of the icon-selecting game are envisioned. The icons 20 may move continuously so the players do not have to reach across the screen 18. Alternatively, the icons 20 may be stationary and randomly positioned after each selection. The color of the icons 20 may indicate the wager amount rather than the wager amount being displayed on the icons 20.

Figure 5:
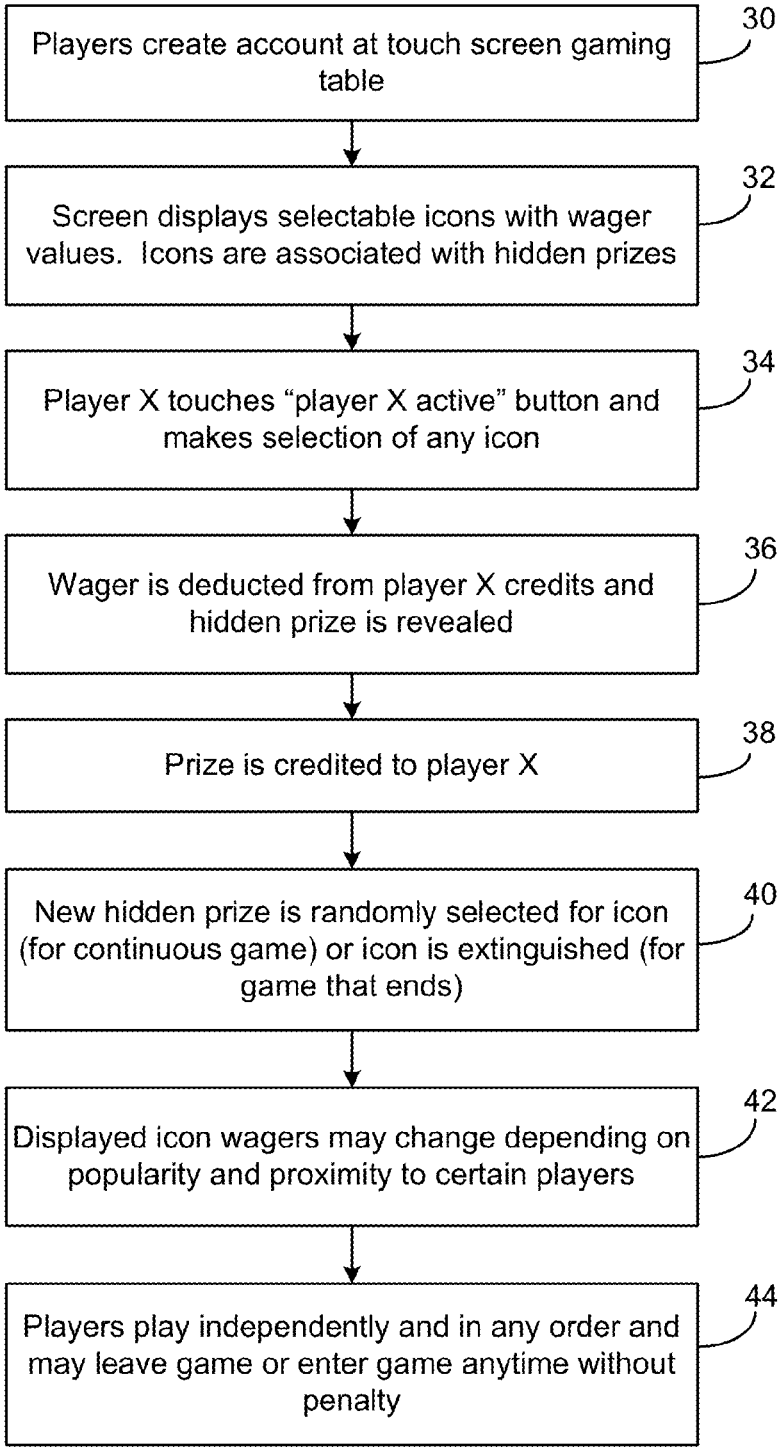
FIG. 5 is a flowchart identifying certain steps for carrying out the game of FIGS. 1-4.

FIG. 5 identifies various steps performed in accordance with one embodiment of the invention of FIGS. 1-4.

In step 30, the players create credit banks at the touch screen gaming table 10. In step 32, the icons 20 are displayed with their wager (or bet) values. In step 34, a player touches the "active player" button 24 and selects an icon 20. In step 36, the wager is deducted from the player's bank of credits and the hidden prize is revealed. In step 38, the revealed prize is credited to the player. In step 40, a new hidden prize is randomly assigned by the gaming system for a new icon or for the previously selected icon. Alternatively, the selected icon may be extinguished for a game that ends when all or only some of the icons remain. Note that the term "random" may refer to pseudo-random where the prize is determined by an algorithm. In step 42, the gaming system may dynamically change the number of icons having a certain wager amount or display certain icons more proximate to some players based on the players' history of prior selections. In step 44, the players play independently at their own rate and in any order and may leave or arrive at the game at any stage in the game without penalty.

Figure 6:
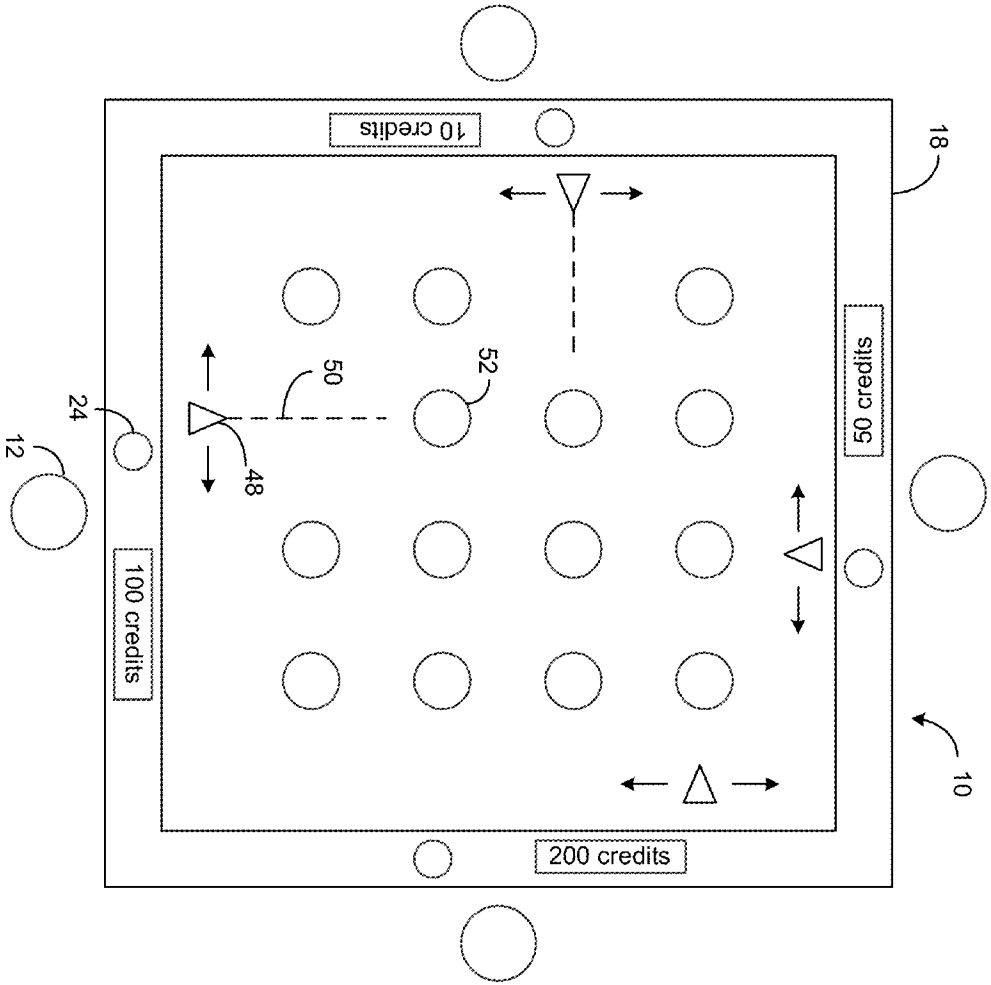
FIG. 6 illustrates a community shooting game where the players play independently and not compete against one another for prizes.

FIG. 6 illustrates a community shooting game on the screen 18 where the players play independently and not compete against one another for prizes. The game illustrated in FIG. 6 may be selected by the casino operator, or by the players, or automatically after a certain period of time to add variety to the players' experience. Thus, the icon selection game may occur for some period of time followed by the shooting game.

In FIG. 6, each player controls a movable gun 48 and its shooting of virtual bullets 50. The object is to hit icons 52 of a desired wager amount. The wager amount of an icon 52 may be displayed directly on the icon 52 or represented by a particular color or shape of the icon 52. This technique may be more fun than simply selecting an icon by touching it.

In one embodiment, each bullet 50 shot is also wager of a very low amount so that the players are motivated to carefully aim their shots at the icons 52.

In one embodiment, when an icon 52 is hit, the wager amount is deducted from the shooter's bank of credits and a hidden prize is revealed. In another embodiment, each bullet 50 is a single wager and the hitting of an icon does not result in an additional wager but just reveals a hidden award.

In such a shooting game, there is no need for a player to touch an "active player" button 24 since the gaming system already knows which bullets 50 are associated with the players.

The players may aim and shoot using touchscreen buttons, a joystick, or by other means.

In another embodiment, an icon 52 must be hit multiple times (e.g., four) before awarding its hidden prize. For example, if a blue icon is associated with a wager of 0.5 cents per shot, and four shots are needed to trigger the icon's prize, then the equivalent wager for the icon is 2 cents. This technique extends the game. In one embodiment, multiple players may hit the same icon and the hits are accumulated. After the required number of hits (e.g., four) the hidden prize is revealed and split among the players based on each player's number of hits.

In one embodiment, the icons 52 move around to give the players equal chances to hit each icon 52.

In another embodiment, the icons 52 assume four different colors (or a number equivalent to the number of active players), each color being associated with a certain player, and a player is given credit for shooting the player's associated icons 52. The icons 52 may change color after each hit, and the hidden prize is only rewarded after a certain number of hits (e.g., one per player) so that the players have to work together to win the hidden prize. The resulting prize may then be shared equally.

In another embodiment, the first hit starts a clock (e.g., a 30 second clock), and the icon 52 must be hit a certain number of additional times before the clock runs out in order for a prize to be awarded. In such an embodiment, the icon 52 should be hit by a single player so that another player's poor shooting does not adversely affect other players.

In the game of FIG. 6, if there is sufficient randomness in shooting the icons 52, the prize awarded for a successful hit(s) need not be a hidden prize but may be a predetermine fixed prize for the particular icon.

Figure 7:
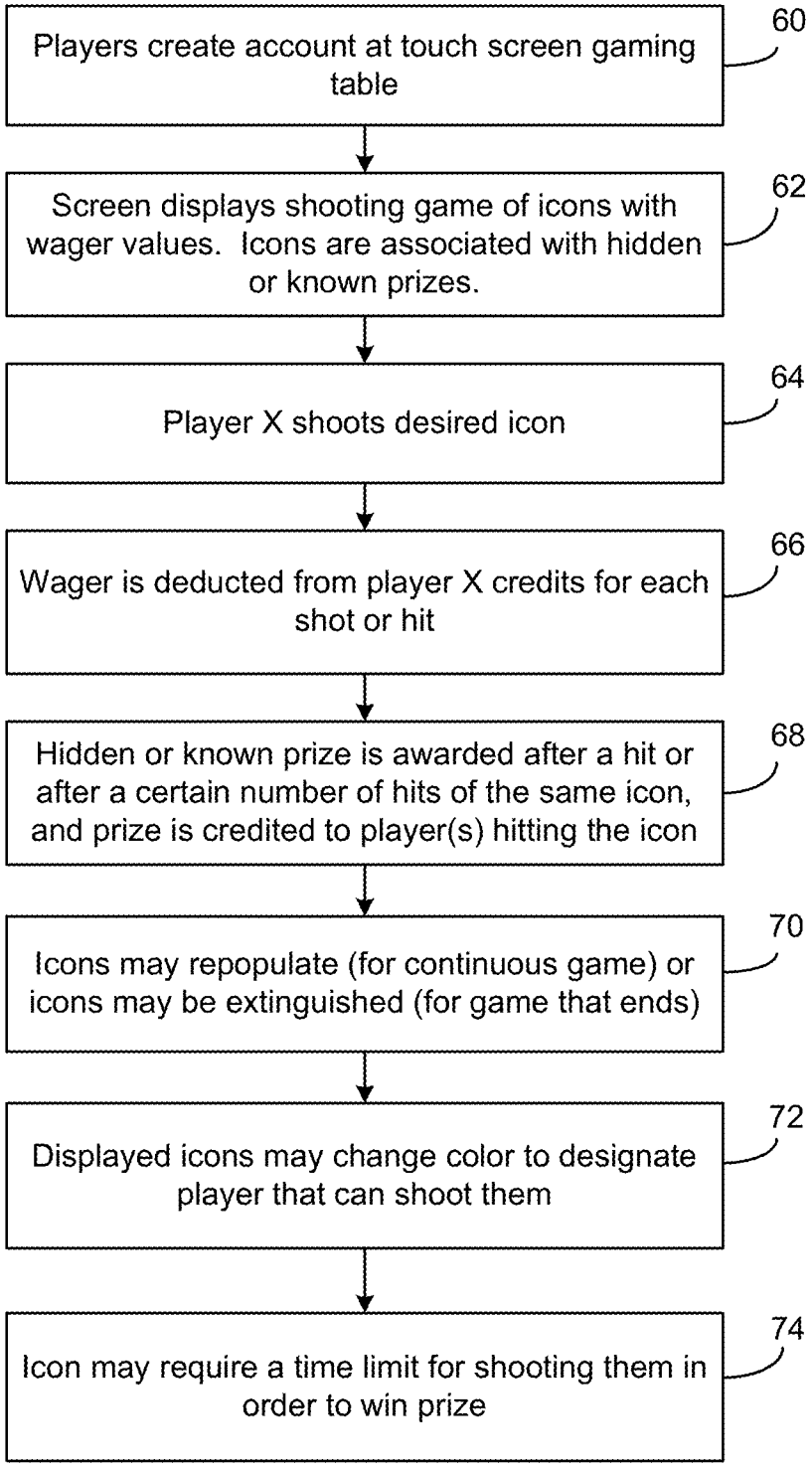
FIG. 7 is a flowchart identifying certain steps for carrying out the game of FIG. 6.

FIG. 7 is a flowchart identifying certain steps for carrying out one embodiment of the shooting game of FIG. 6. In step 60, the players create credit banks at the touch screen gaming table 10. In step 62, the icons 52 are displayed with their wager (or bet) values. The icons 52 may be associated with hidden or known prizes. In step 64, the wager is deducted from the shooting player's bank of credits for each shot or hit. In step 66, the wager is deducted from the player's bank of credits and the hidden prize is revealed. In step 68, after a hit or a certain number of hits, the revealed or known prize is credited to the player(s) hitting the icon 52. In step 70, a new hidden prize is randomly assigned by the gaming system for a new icon (for a continuous game) or the hit icon may be extinguished for a game that ends when all or only some of the icons remain. In step 72, the icons may change color after being shot to designate the next player that may shoot it. In step 74, the icon may require a time limit for shooting it one or more times in order to win the prize.

Figure 8:
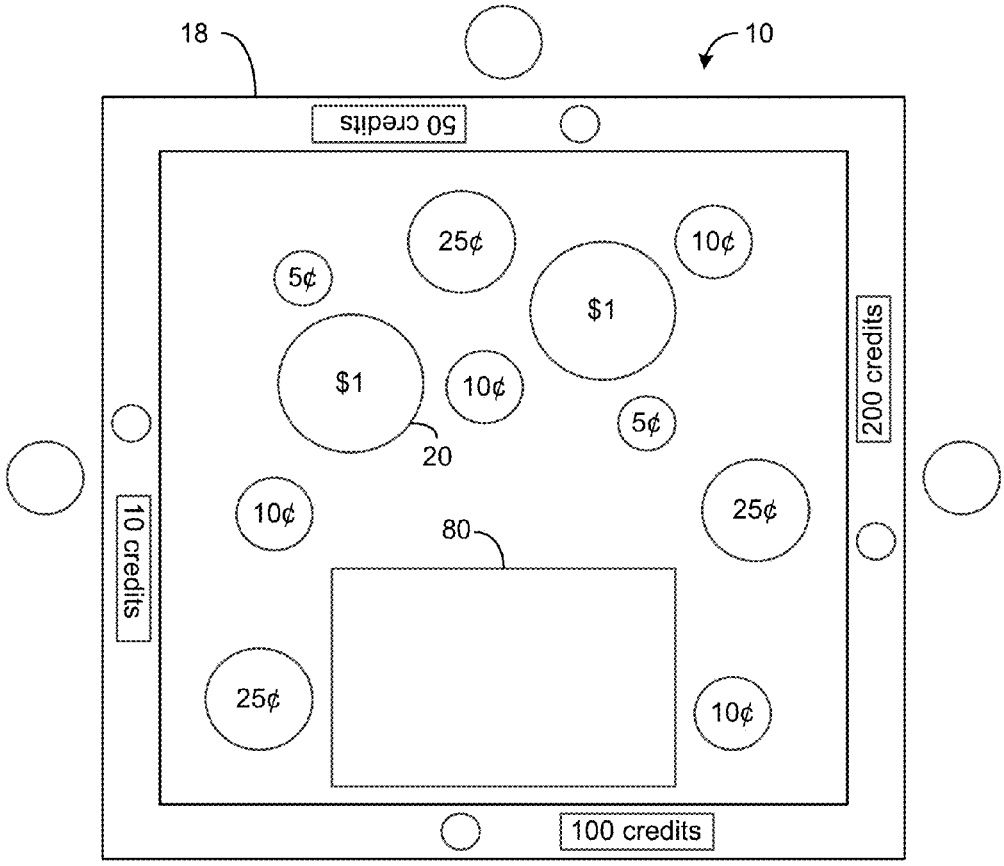
FIG. 8 illustrates how any or all players may elect to play an individual game on a portion of the large screen.

FIG. 8 illustrates how any or all players may elect to play an individual game on a portion 80 of the large screen 18. Any game may remain as the community game, such as the games of FIG. 1 or FIG. 6 or any other game, and the community game is not affected by any player choosing to play an individual game. The gaming system may adapt the community game, as needed, due to the portion 80 not being used for the community game. The player 12 may select from a variety of games (including any community game) by touching a selection button, which displays a menu of available games in the portion 80. The player 12 then selects any available game, such as a conventional video poker game, a conventional video reels type game, etc., and plays the game in a conventional way. Any number of players may play individual games. Even a single player may be able to player the "community game," since it is desirable that no action by any player can adversely affect another player's enjoyment of all the games offered by the gaming table 10. In one embodiment, a player playing an individual game may also simultaneously participate in a community game by selecting a community game to join.

In another embodiment, the player 12 may choose to initiate another community game in portion 80, and additional players may elect to join the community game by menu selection. The community game screen display would then expand to the other players' locations (e.g., from 25% of the screen 18 to 50% of the screen 18). None of the players' gaming experiences are interrupted by such selections. The players may even elect to simultaneously participate in multiple community games.

Figure 9:
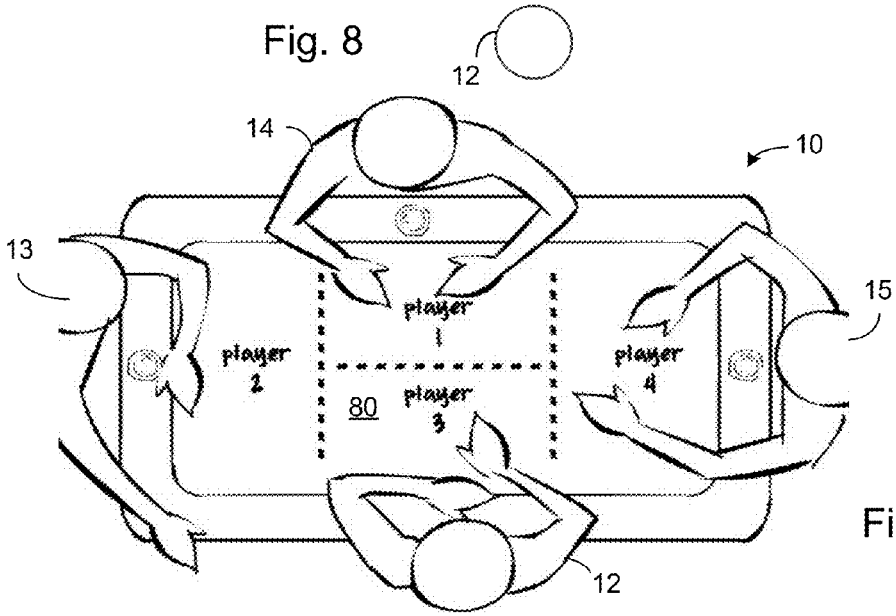
FIG. 9 is a top down view of the players' associated areas on the gaming table.

FIG. 9 is a top down view of a rectangular gaming table 10 for four players. Dashed lines illustrate the areas of the screen associated with the respective players, where a selection by a player to play an individual game causes that selected game to appear in the designated area of the screen.

Accordingly, there is no drawback for a casino to add such gaming tables 10 since the tables 10 offer more variety that the conventional video slot machines. One gaming table 10 is anticipated to cost less than four separate conventional gaming machines and take up less area. Player will typically play at the gaming table 10 longer than at a conventional gaming machine due to the variety and social aspect of the gaming experience. Accordingly, the gaming table 10 provides synergy by lowering costs, increasing playing time, and providing more options than afforded by conventional gaming machines.

Figure 10:
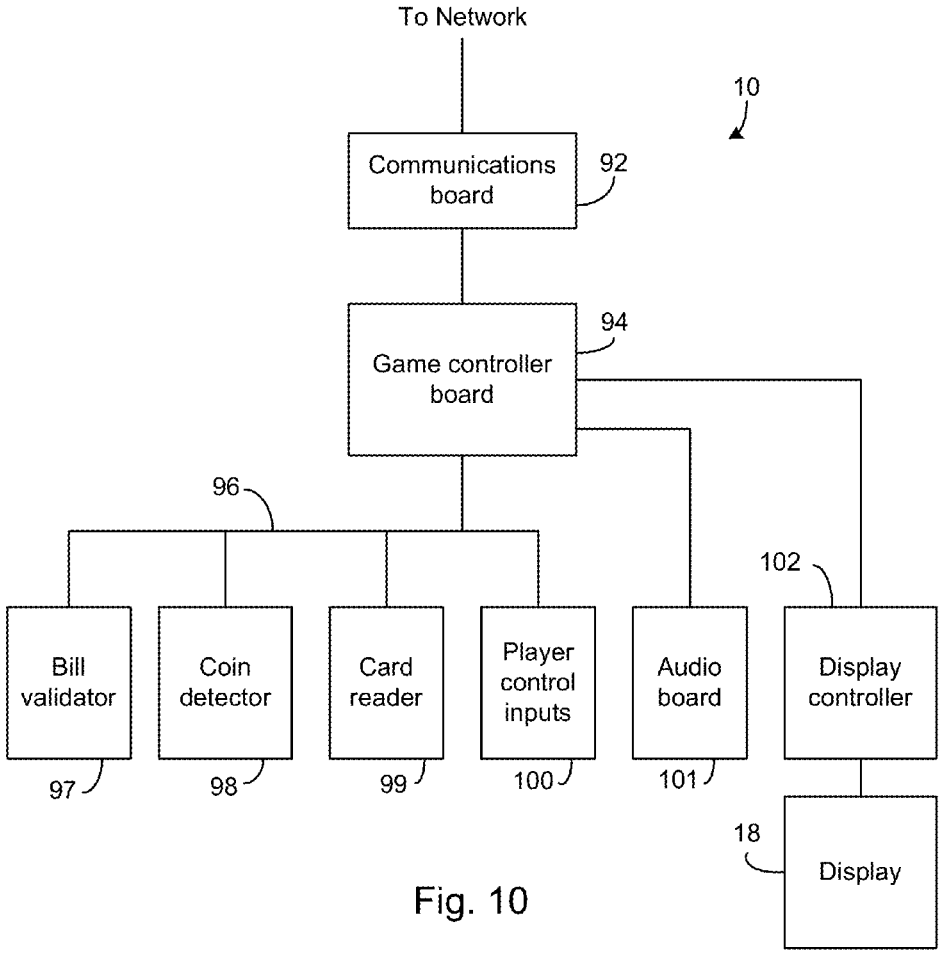
FIG. 10 illustrates various functional blocks that may be included in the gaming system.

FIG. 10 is a diagram of the electronic functional units in the gaming table 10, in accordance with one embodiment of the invention. The gaming system may use conventional hardware.

A communications board 92 may contain conventional circuitry for coupling the gaming table 10 to a local area network (LAN) or other type of network using any suitable protocol. The gaming table 10 may thus be monitored and programmed remotely, and the players' credits may be stored in a central system memory.

A game controller board 94 contains memory and a processor for carrying out programs stored in the memory and for providing the information requested by the network. The game controller board 94 primarily carries out the game routines.

Peripheral devices/boards communicate with the game controller board 94 via a bus 96 using, for example, an RS-232 interface. Such peripherals may include a bill validator 97, a coin detector 98, a player tracking card or other card reader 99, and player control inputs 100 (such as touch screen inputs). Payment may be by printed ticket, cash, electronic transfer or other means. An audio board 101 converts coded signals into analog signals for driving speakers. A display controller 102 converts coded signals to pixel signals for the screen 18.

The electronics on the various boards may be combined onto a single board.

The gaming system has been described above as a dedicated physical gaming table in a casino or other establishment. However, the gaming table 10 may be a virtual table such as displayed using a suitable generic computer or mobile device connected to a network via the internet and programmed to carry out the inventive methods. The gaming table 10 of FIG. 1 may itself be a screen image with the players being avatars. Icon selection may be by touch screen, a mouse, a joystick, or other means. The gaming system may access a gaming site or a social website (e.g., Facebook) via the internet, wherein the remote gaming site controls various aspects of the game and allows remote players to participate in games using the same virtual table. All players view the same community game display on their separate player interfaces, such as smartphones, pads, home computers, etc. The players' inputs may be transmitted to a remote server and conveyed to the other players' display screens. Chatting between players may be an added feature. For gaming via the internet, the wagering would typically be by credit card or accessing an existing account. Awarding the player may be by crediting the player's account. For portable computing devices, Near Field Communications (NFC), such as Bluetooth, may be used as a player interface to play on an actual or virtual gaming table 10 shared by a plurality of players. Any number of players may participate in a virtual shared gaming table 10.

Figure 11:
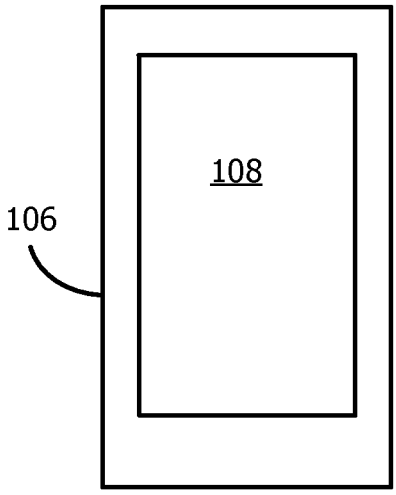
FIG. 11 is a front view of a smartphone having a screen for playing the game.

FIG. 11 is a front view of a smartphone 106 having a screen 108 for playing the game.

Those skilled in the art may write the appropriate software to carry out the invention without undue experimentation. The hardware used may be conventional.

While particular embodiments of the present invention have been shown and described, it will be obvious to those skilled in the art that changes and modifications may be made without departing from this invention in its broader aspects. The appended claims are to encompass within their scope all such changes and modifications as fall within the true spirit and scope of this invention.

What is claimed is:

1. A method for operating a gaming system comprising:

providing a screen;

generating credits for one or more players for playing a game on the screen;

concurrently displaying a plurality of icons on the screen, each icon being visually associated with a particular wager amount, wherein the icons concurrently displayed are associated with a plurality of different wager amounts, and wherein at least some of the icons are associated with a hidden prize;

receiving signals generated by a player controlling an actuator for shooting the icons with virtual projectiles;

upon a projectile hitting an icon, deducting the wager amount associated with the icon hit by the projectile from a bank of credits associated with the player; and granting any award to the player associated with the icon hit by the projectile.

2. The method of claim 1 wherein hitting an icon with the projectile provides an instant prize.

3. The method of claim 1 wherein a number of icons must be hit prior to a prize being awarded to the player.

4. The method of claim 1 wherein the player also controls positioning of a projectile launcher when shooting the icons.

5. The method of claim 1 wherein the icons move.

6. The method of claim 1 wherein the game is a community game, the method further comprising:

providing a screen, supported horizontal to a floor over which the screen is supported, for access by a plurality of players around the screen;

receiving signals from the plurality of players shooting the icons with projectiles associated with each player;

upon a projectile hitting an icon, deducting the wager amount associated with the icon hit by the projectile from a bank of credits associated with the player that shot the icon; and granting any award to the player associated with the icon hit by the projectile.

7. The method of claim 6 wherein hitting an icon with the projectile provides an instant prize.

8. The method of claim 6 wherein a number of icons must be hit prior to a prize being awarded to the player.

9. The method of claim 6 wherein the players also controls positioning of a projectile launcher when shooting the icons.

10. The method of claim 6 wherein the icons move.

11. The method of claim 1 wherein each projectile is associated with a wager amount, the method further comprising deducting the wager amount for each projectile shot by the player from the player's bank of credits.

12. The method of claim 1 wherein the screen is part of a gaming table.

13. The method of claim 1 wherein the screen is part of a portable computing device.

14. The method of claim 13 wherein the screen is part of a smartphone.

15. The method of claim 1 wherein the game is played via the internet using a touch screen as a player interface communicating with a remote server.

16. The method of claim 1 wherein, on average, awards associated with higher wager icons are greater than awards associated with lower wager icons.

17. A gaming system comprising:

a screen, supported horizontal to a floor over which the screen is supported, for access by a plurality of players around the screen;

a game processing system programmed to carry out the following method:

generating credits for a plurality of players for playing a game on the screen;

concurrently displaying a plurality of icons on the screen, each icon being visually associated with a particular wager amount, wherein the icons concurrently displayed are associated with a plurality of different wager amounts, and wherein at least some of the icons are associated with a hidden prize;

receiving signals from the plurality of players shooting the icons with projectiles associated with each player;

upon a projectile hitting an icon, deducting the wager amount associated with the icon hit by the projectile from a bank of credits associated with the player that shot the icon; and granting any award to the player associated with the icon hit by the projectile.

18. The system of claim 17 wherein each projectile is associated with a wager amount, the method further comprising deducting the wager amount for each projectile shot by the player from the player's bank of credits.

* * * * *